United States Patent [19]

Conway et al.

[11] 4,194,432

[45] Mar. 25, 1980

[54] APPARATUS FOR MAXIMIZING THE FIRING FIELD OF A ROTATABLE GUN

[75] Inventors: Raymond J. Conway, Mountain View; Hasmukh T. Shah, San Jose, both of Calif.

[73] Assignee: FMC Corporation, San Jose, Calif.

[21] Appl. No.: 854,942

[22] Filed: Nov. 25, 1977

[51] Int. Cl.[2] ..... F41G 5/14

[52] U.S. Cl. ..... 89/41 C; 89/134

[58] Field of Search ..... 89/41 C, 134

[56] References Cited

U.S. PATENT DOCUMENTS

| | | | |
|---|---|---|---|
| 2,628,535 | 2/1953 | Terwilliger et al. | 89/41 C |
| 3,618,456 | 11/1971 | Mindel | 89/134 |
| 3,731,589 | 5/1973 | Pfeiffer et al. | 89/41 C |
| 4,079,658 | 3/1978 | Brennan | 89/41 C |

FOREIGN PATENT DOCUMENTS 1016153 1/1966 United Kingdom .

OTHER PUBLICATIONS

Francis W. Sears, Mechanics, Heat, and Sound, 1950, pp. 52–55 and 168–171.

*Primary Examiner*—Stephen C. Bentley
*Attorney, Agent, or Firm*—R. S. Kelly

[57] ABSTRACT

An armored vehicle is provided with a gun mounted upon its top deck which gun is capable of rotation through 360° C. about a vertical axis. The gun is also simultaneously elevatable through an angle of about 70°. Located upon the deck are a plurality of barriers (some fixed and some conditional, e.g., opened hatches) which the gun must avoid during its rotational movement. The apparatus of the present invention includes a programmable read-only-memory which stores the location and height of each of the barriers on the deck. A computer continuously checks the position of the gun against the location of each of these barriers and provides signals which prevents the gun from moving into forbidden zones which include the locations of these barriers. As the gun approaches any of the barriers a signal is generated which causes the gun to be elevated from its normal path (if necessary) and lifted over the barrier. The distance from the barrier at which the upward movement of the gun starts is determined by the speed of movement of the gun, the elevation of the gun, and the height of the barrier. Thus, if the gun is moving slowly and the barrier is relatively low the gun can be moved very close to the barrier before any lifting of the gun occurs. If the gun is moving more rapidly, or if the barrier is relatively high, the upward movement of the gun is started at a greater distance from the barrier so that the gun can be lifted over the barrier without inhibiting the horizontal rotational movement of the gun. The apparatus includes means for inhibiting the firing of the gun when the gun control system takes over.

26 Claims, 12 Drawing Figures

FIG_1
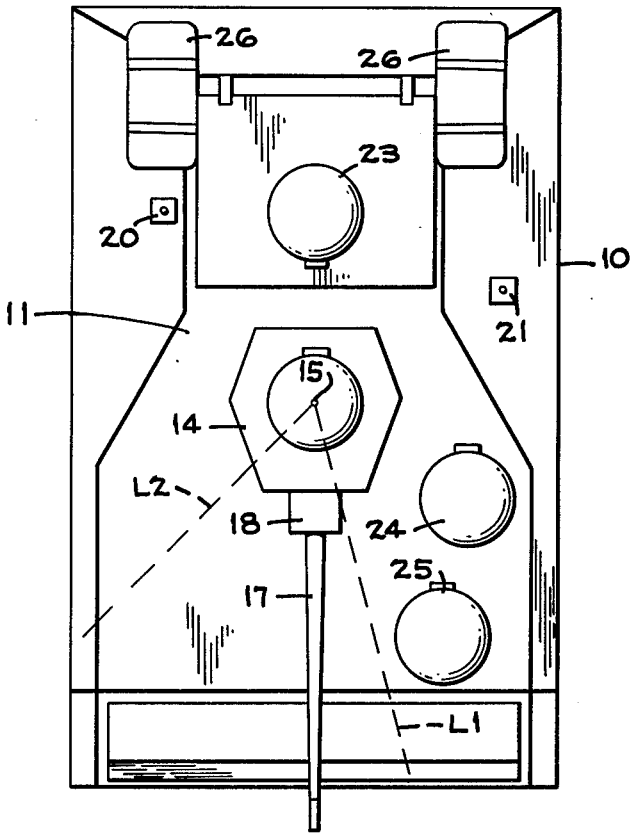
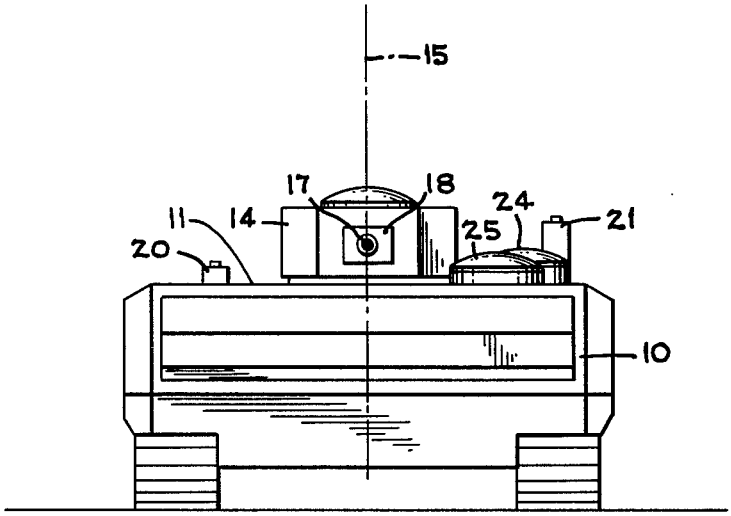
FIG_2

APPARATUS FOR MAXIMIZING THE FIRING FIELD OF A ROTATABLE GUN

BACKGROUND OF THE INVENTION

1. Field of the Invention

The present invention pertains to a gun control system for use with a rotatable gun, and more particularly, it pertains to an apparatus for maximizing the field of fire of a rotatable gun by automatically controlling its movement when it is near a rotative position where either firing or movement is forbidden.

2. Description of the Prior Art

Gun carrying vehicles, such as armored tanks, carry a gun on a turret which is mounted on a deck atop the vehicle and which can be rotated to move the gun in an azimuthal direction to aim the gun in any direction from the vehicle. In addition to moving in an azimuthal direction the gun can typically be elevated through a predetermined acute angle above the horizontal position of the deck. Positioned at several locations about the turret are various types of barriers, such as antenna mounts, personnel hatches and cargo hatches, which could be struck by the moving gun barrel unless the gun operator visually avoids them or a control system is provided for automatically checking the position of each barrier relative to the position of the gun and for taking over the control of the gun when it is near a barrier so that it will not strike the barrier. It is important that the control system operate in a manner such that the gun is left in the control of the operator for the maximum period of time so as to permit maximum firing but at the same time insure against collisions with the barriers.

The rotational movement of the gun turret and the elevation of the gun are usually controlled by a hydraulic system which provides the power for these movements. Electrical signals are provided to a plurality of hydraulic valves which operate hydraulic motors to provide the separate movements of the gun and turret. A finite amount of time is required to energize each of these valves and to operate the hydraulic motors to raise the gun or to stop rotation of the turret. Thus, if the turret is rotating and the gun is approaching one of the barriers on the deck of the vehicle, a signal to raise the gun must be provided a certain amount of time before the gun reaches the barrier. When the turret is moving at a rapid rate this signal must be provided earlier than it need be if the turret is moving at a slow rate in order for the gun to be elevated far enough to clear the barrier. In the prior art gun control systems means were provided for automatically elevating the gun as it neared a barrier so that it would not hit the barrier but there were no means provided for detecting the speed of the gun and for using this information to determine the particular point at which the gun must be raised in order to clear the barrier at the given speed of rotation of the turret. Thus, the maximum rotational speed of the turret was used to determine the point at which the gun must start moving upward in order to clear the barrier. This meant that the gun moved upwardly (and thus off the target) much sooner than was necessary when the turret was moving the gun at a slow rate of speed.

SUMMARY OF THE INVENTION

The present invention provides a control system for maximizing the field of fire of a rotatable gun where a plurality of barriers are located in the rotational path of the gun. The control system includes a computing means and means for providing the computing means with signals indicative of the size and location of each of the barriers and of the horizontal and the vertical positions of the gun. The computing means, by using successive gun position signals, calculates the speed of movement of the gun. The computing means uses this calculated speed of movement of the gun and the gun position signals to then determine when to elevate the gun to clear the barriers so that the control system will control the movement of the gun for a minimum period of time—thereby maximizing the field of fire of the gun.

BRIEF DESCRIPTION OF THE DRAWINGS

FIG. 1 is a diagrammatic plan view of a gun carrying vehicle showing the position of the gun and the barriers which are located on the deck of the vehicle, such vehicle using the gun control system of the present invention.

FIG. 2 is a diagrammatic front elevation view of the gun carrying vehicle of FIG. 1.

FIG. 6 is a graphic illustration of the deck of the gun carrying vehicle of FIGS. 1 and 2 showing the locations of and the heights of the barriers on the deck at different azimuth angles.

DESCRIPTION OF THE PREFERRED EMBODIMENT

Figure 3:
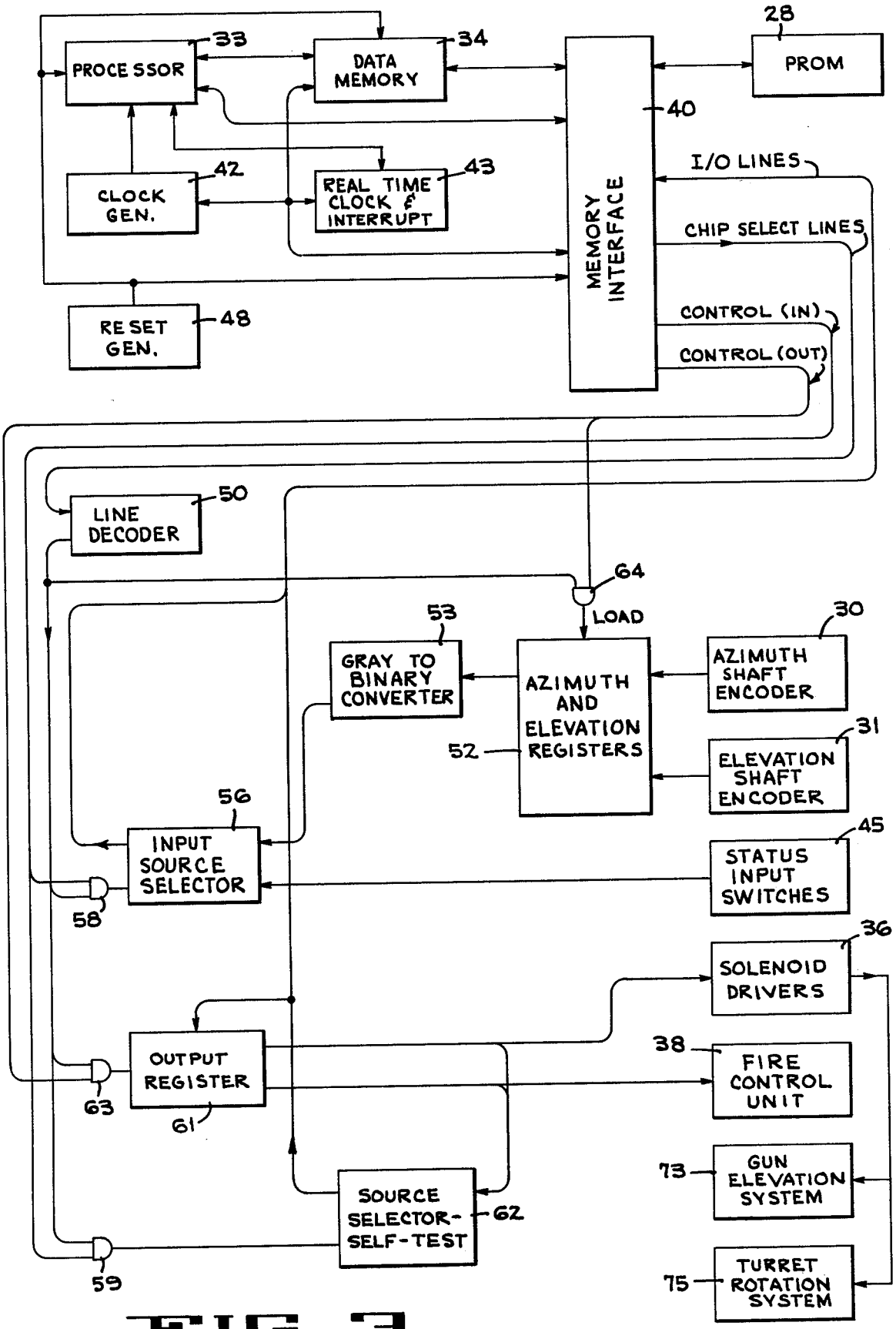
FIG. 3 is a basic block diagram representation of the gun control system of the present invention and the electronic circuitry therefor.

Referring now more particularly to the drawings, FIG. 1 will be seen to comprise a diagrammatic plan view of a gun carrying vehicle 10 having an upper deck 11. A rotatable gun turret 14 is mounted near the center of the gun deck and is capable of revolving about a central vertical axis 15 through a full 360°. The turret carries a gun 17 which can therefore be aimed in all directions from the vehicle as the turret revolves. The gun is mounted on a gun mount 18 which is movable up and down in relation to the gun turret so that the gun can be elevated above the horizontal plane and can be depressed slightly below the horizontal plane. On the deck 11 of the vehicle there are provided a number of barriers, such barriers being defined as objects which may be struck by the gun as it is moved through its various azimuthal and elevational positions. These various barriers—which includes a pair of antenna mounts 20 and 21, a cargo hatch 23, a commander's hatch 24, a driver's hatch 25, and sleeping bags 26—present obstacles which must be avoided by automatically raising the gun so that it moves over the barrier as the gun approaches the barrier. As will be explained in greater detail hereinafter, some of the barriers are fixed and some are "conditional"—a "conditional" barrier being one which may or may not be present. For example, an opened hatch would present a "conditional" barrier while a closed hatch (at a lower elevation) would be a fixed barrier. Also, it may be desirable at certain times, to limit the firing of the gun to a particular sector such as between a left sector limit L1 and a right sector limit L2, e.g., to prevent the firing of the gun into areas where friendly troops may be operating. The location of each of these sector limits may be readily changed, or, the limits may be eliminated by closing a pair of push-button switches in a manner to be explained further hereinafter. FIG. 2 is a front elevation view of the gun carrying vehicle 10 illustrating the relative heights of the barriers on the deck 11.

The circuitry of the present invention is represented in block diagram form in FIG. 3 of the drawings. The basic computing is provided by a conventional microprocessor 33 which operates in conjunction with a random access memory (RAM) 34 that stores data during each processing cycle. The microprocessor is driven by a clock pulse generator 42 which provides a train of output pulses at 740 kilohertz. A real time clock and interrupt circuit 43 is utilized to divide down the pulse train from the clock pulse generator and to provide interrupt pulses at 44 millisecond intervals to the microprocessor to initiate each new data processing cycle. Control over the manner in which the microprocessor operates is provided by a programmable read only memory, or PROM 28 acting through a conventional interface circuit 40. The various registers in the interface circuitry, the microprocessor, and the data memory circuit are reset by a reset generator 48.

As further shown in FIG. 3, inputs to the processing circuitry of the present invention are provided by an azimuth shaft encoder 30, an elevation shaft encoder 31 and status input switches 45. The encoders function in the conventional manner to monitor the instantaneous position of the gun 17 in both azimuth and elevation while the status switches 45 provide the status (open or closed) of the hatches 23, 24, and 25 and determine whether or not the hatch 24 is in a "critical condition". The commander's hatch 24, which is rotatable, is considered to be in a "critical condition" when it is rotated into a position such that it may interfere with the rotatable movement of the gun turret 14. When such a condition is sensed, the control circuitry of the present invention acts to prevent further rotation of the gun turret.

The output of the processing circuitry of the present invention is provided by solenoid driver circuits 36 which control the various hydraulic mechanisms that drive the gun elevation system 73 and the turret rotation system 75. Also, the output circuitry includes a fire control unit 38 which receives the signals to inhibit the firing of the gun during those situations wherein the control circuitry has taken over the control of the gun from the operator thereof.

As further shown in FIG. 3, communication between the memory interface 40 and the various input and output circuits is provided over a series of lines or cables. All input and output data is transferred over the indicated "I/O lines" while signals relating to the particular data to be sent or received at any given time is transmitted over the indicated "chip select lines". Further, when data is to be transferred into the memory interface a control (in) line will be energized, and a control (out) line will be energized when data is to be transferred out of the memory interface. As can be seen from FIG. 3, data that is transferred into the memory interface is provided from an input source selector circuit 56 or from a source selector self-test circuit 62, the latter being only used in testing situations in a manner to be explained in detail hereinafter. Data which is output from the interface circuit 40 is delivered to an output register 61. The input data from the shaft encoders 30 and 31 is provided at azimuth and elevation registers 52 with such data thereafter being converted in a gray code to binary converter 53 and transferred through the input source selector circuit. The data in output register 61 is transferred directly to the solenoid driver circuits 36 or the fire control unit 38 where such data is converted into a signal form usable in controlling the various hydraulic or electronic elements associated therewith. The chip select lines signals are provided to a line decoder circuit 50 which sequences all of the data into and out of the memory interface 40 in the proper order, and finally, output signals from the line decoder are provided to enable various gates 64, 58, 63, and 59 which clock information through the various input and output circuits 52, 56, 61, and 62, respectively.

Figure 4A:
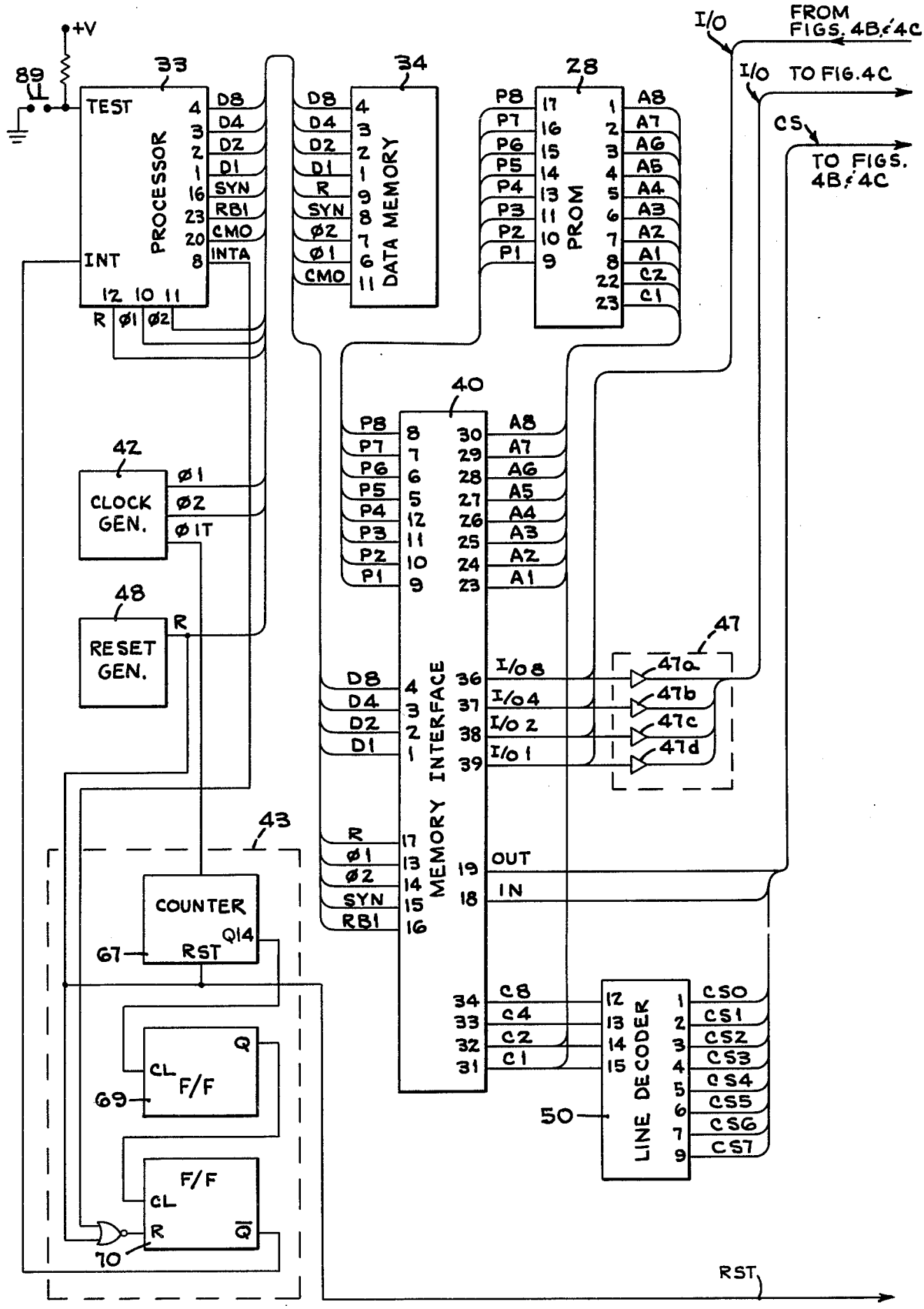
FIGS. 4A, 4B, and 4C together comprise an electrical schematic diagram of the gun control system circuitry.
Figure 4B:
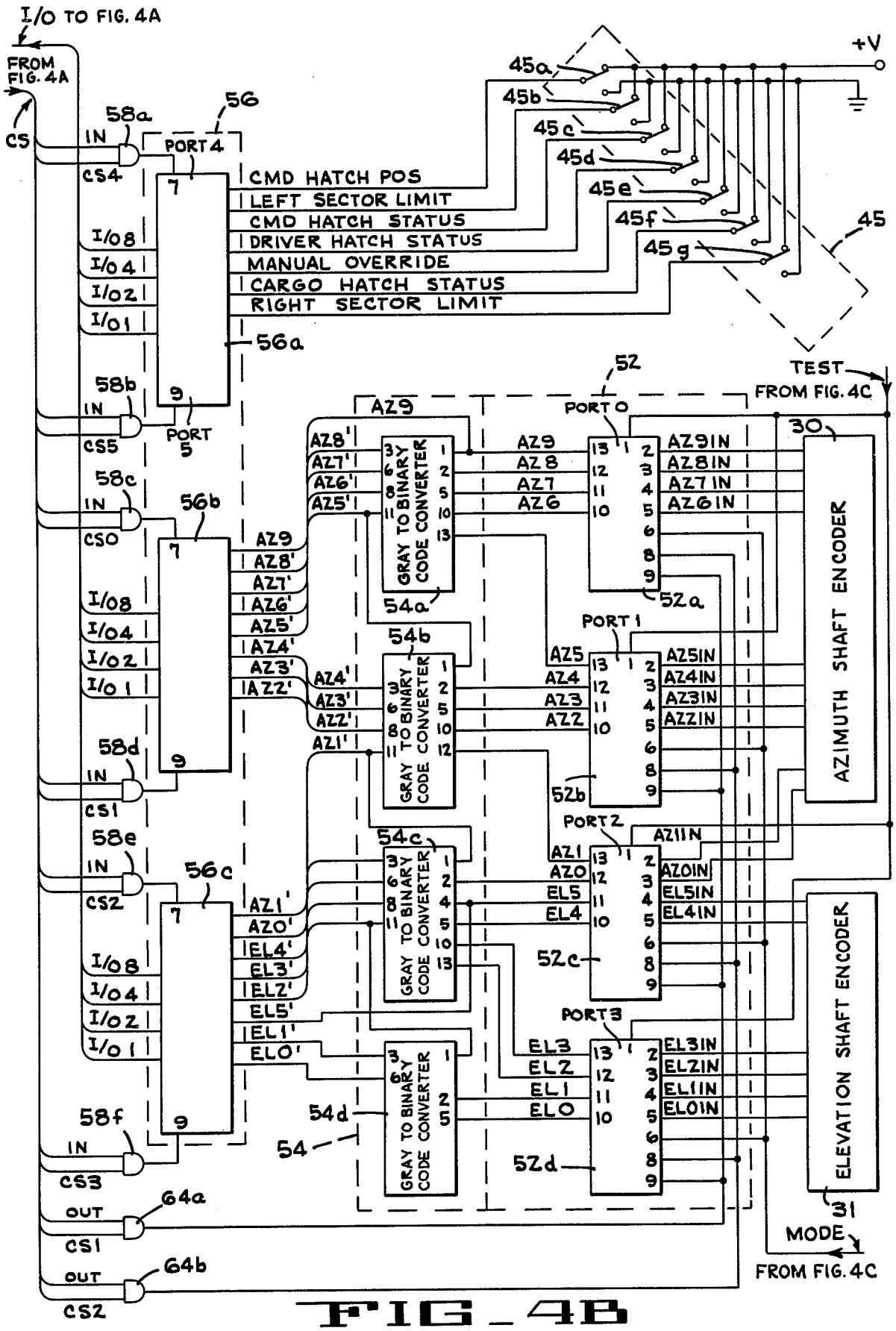
Figure 4C:
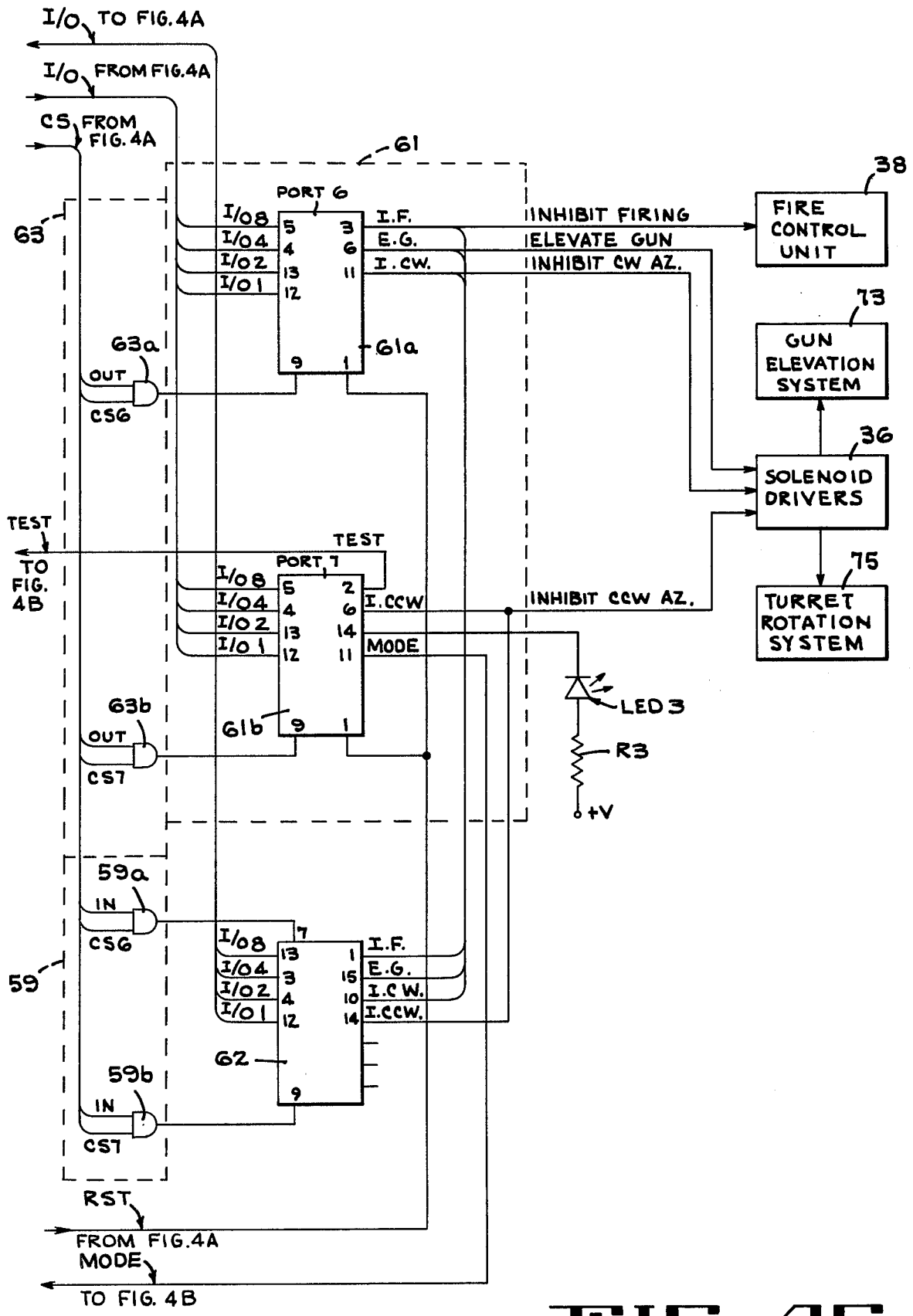

Further details of the circuitry of the present invention may be seen by referring to the more detailed FIGS. 4A–4C where FIG. 4A comprises the computer section of the circuitry, FIG. 4B includes the section for providing input data to the computer section, and FIG. 4C includes the output section of the circuitry. The leads shown on these drawing figures represent single wires when square corners are shown, and they represent cables having a plurality of wires when rounded corners are shown in the leads. In the embodiment of the invention which is diagrammatically depicted in said drawing figures, the programmable memory, or PROM, 28 (FIG. 4A) stores the angular location and height of each of the barriers on the deck of the vehicle 10. As mentioned, the shaft encoders 30 and 31 (FIG. 4B) provide azimuth and elevation information to the microprocessor 33 (FIG. 4A) which stores this information in the data memory 34 while it is being processed. The status input switches 45 (FIG. 4B) also supply data to be loaded into the data memory 34. The present status data from data memory 34 is compared with the barrier information from the PROM 28 to determine if the gun is moving toward one of the barriers which is located on the deck of the weapons carrier and to further see if the height of the gun is sufficient to clear such barrier. The microprocessor determines the rate of movement of the gun, checks its acceleration, and determines the precise moment when the gun should be lifted to prevent the gun from colliding with the barrier. As the gun approaches the barrier, a signal is generated by the microprocessor and sent to one of the solenoid drivers 36 (FIG. 4C) to cause the gun to be lifted over the barrier. If the gun is too close to the barrier to be lifted over the barrier at the present azimuth speed, a signal is generated which stops the azimuthal movement of the gun until the gun is properly elevated.

The control system of the present invention also includes means for generating signals which prevent the firing of the gun outside a set of predetermined azimuth limits. The location of each of these azimuth limits is set by closing the appropriate sector limit switches **45*b* and 45*g* (FIG. 4B) when the gun is in the correct azimuth limit locations. The signals from the status input switch circuitry 45 will then cause the current azimuth information to be stored in the data memory 34 as the azimuth limits. Obviously, the azimuth limits can be readily changed merely by moving the gun 17 to different azimuthal positions and closing the appropriate switches 45***b* and 45*g*. When the two switches 45*g* and 45*b* are closed simultaneously, the microprocessor functions to eliminate all of the azimuth limits. The microprocessor 33 uses the azimuth speed and the position of the azimuth limits to determine when an "inhibit fire" signal should be sent to fire control unit 38 (FIG. 4C) to prevent the gun from firing.

The microprocessor 33 (FIG. 4A) includes a small scratch pad memory (separate and apart from the data memory 34) which can be used to temporarily store data during processing, an accumulator (or master register) which performs the operations for manipulating data, and a program counter which stores the address of the step of the computer program that is being executed. One microprocessor which may be used in the circuitry of the present invention is Model No. 4040 which is built by the Intel Corporation, Santa Clara, Calif. Details of the Intel Model No. 4040 processor may be found in the Intel 1976 Data Catalog.

The data memory 34 may be a random access memory, or RAM, having discreet addressable storage locations, each of which provides storage for a data word. The data word contains specific information useful in a variety of operations and such information is placed in the memory by the processor 33. Normally, when the processor is in need of data or instructions it will generate a memory cycle and provide an address to the program memory 28 or to the data memory 34. The data word stored at the addressed location will subsequently be retrieved and provided to the processor 33.

The program memory 28 may be a programmable-read-only-memory, or PROM, which is available from several manufacturers. Communications between the program memory 28 and the microprocessor 33 takes place through the memory interface 40 as shown in FIG. 4A. One memory interface circuit which may be used in the circuitry of the present invention is Standard Memory Interface circuit No. 4289 which is built by the Intel Corporation of Santa Clara, California and is described in the aforementioned Intel 1976 Data Catalog.

A series of instructions, comprising the program, and specific information related to the deck clearance map (see FIG. 6) is loaded into the program memory 28 as, for example, by a "PROM programmer" which is readily available from several manufacturers. The contents of the program memory 28 cannot be changed by the microprocessor 33. The contents of memory 28 can only be changed by removing the PROM from the circuitry of FIG. 4A and inserting it into a PROM programmer where data may be removed and new data stored in the memory.

The deck clearance map illustrated in FIG. 6 shows the height of the barriers relative to the deck with the zero azimuth position being shown as the position where the gun 17 is pointed straight ahead over the front portion of the carrier deck, as shown in FIGS. 1 and 2. The map of FIG. 6 includes an area between the zero position and the 136° position where the gun may be depressed to an angle of about −10° and may be elevated to whatever its maximum elevation angle may be, for example, 60° above the carrier deck. The antenna mount 20 and a sleeping bag 26 between the 136° position and the 162° position permit the gun to be lowered only to approximately the −2.3° level. Between the 162° position and the 200° position is a conditional barrier, the cargo hatch 23, which has a height above the deck of about +3° when the hatch is open and has a height of about −4.5° between the 162° position and the 190° position when the hatch is closed. The antenna mount 21 poses a barrier of about +5° from about 232° to 246°, and the closed commander's hatch has a height 0° starting at about the 282° position. Another conditional barrier is the driver's hatch 25 between the 315° position and the 348° position which poses a barrier of about +9.5° when open and −1.5° when closed. The position of the leading edge of each of these barriers, the height of each of these barriers, and the position of the trailing edge of each of these barriers are stored as permanent data in the program memory 28. The commander's hatch (when open) is not included as a part of the deck map as the gun 17 cannot be elevated over an open commander's hatch; hence, azimuthal movement of the gun must be stopped as the gun approaches an opened commander's hatch.

The open/closed status of the driver's hatch 25, the cargo hatch 23, and the commander's hatch 24, and the status of the rotative position of the commander's hatch determine the value of a voltage signal which is supplied to the processing circuitry by a plurality of switches 45*d*, 45*f*, 45*c* and 45*a*, respectively, shown in FIG. 4B. When any of the aforementioned hatches are closed or the commander's hatch is not in a critical rotative position the corresponding switch is in a position such that a positive voltage is coupled to one of the input leads of the storage register 56*a*. When any of the hatches are open or the commander's hatch is in the critical position the corresponding switch provides a value of zero volts to the storage register.

The azimuth shaft encoder 30 and the elevation shaft encoder 31 provide 10-bit and 6-bit signals, respectively, which are stored in the input storage registers 52*a*–52*d*, as shown in FIG. 4B. While several types of shaft encoders may be connected to the elevation and azimuth drive shafts to provide the digital output signals, shaft encoders which are particularly adapted for providing position signals in a system such as that of the present invention are shaft encoder Model Nos. GCC26-10Gl and GCC26-6Gl manufactured by Litton Industries Inc. of Chatsworth, Cal. and used as the azimuth shaft encoder and the elevation shaft encoder, respectively.

The operation of the system of the present invention will now be described in connection with the circuitry shown in FIGS. 4A–AC. When power is initially applied to the circuitry of FIGS. 4A–AC, the reset generator 48 (FIG. 4A) develops a negative pulse R which clears all data from the data memory 34, clears all data from the scratch pad memory of the processor 33, clears the accumulator of the processor, sets the program counter of the processor to zero, clears the registers in the memory interface 40, and clears all data from the output registers 61*a* and 61*b* (FIG. 4C).

The clock generator 42 thereafter provides a continuous train of clock pulses which cause the processor 33 to move through the program sequence, starting with program step, or instruction, #1. The program, which is contained in the program memory 28, is moved step-by-step to the processor 33 by the process of having the processor 33 send a fetch command over the lines D8-D1 to the memory interface 40. The memory interface, in turn, sends a 10-bit fetch command to the program memory 28 on lines C1, C2 and A1-A8 to retrieve the program instructions, one at a time, starting with instruction #1. The program instructions are sent, one at a time, on lines P1-P8 to the processor where they are executed.

The instructions in the program, for example, may call for the processor 33 to retrieve and store the data which is provided by the shaft encoders 30 and 31 and to retrieve and store the data which is provided by the status input switches 45*a*–45*g*. In order to retrieve this data the processor 33 sends out a data request signal and the address of one of the six data ports (0–5) comprises of the input registers 52*a*–52*d* and the multiplexing circuit 56*a* (FIG. 4B) from which the data is to be retrieved. This address and data request is sent over lines D8-D1 to the memory interface 40 where the data request is temporarily stored. The memory interface, in turn, sends out the address and request signals over lines C8-C1 to the line decoder 50 (FIG. 4A). The line decoder then decodes the four-bit input signal and selects the input port from which the information is to be received. The output of data is similarly handled by addressing through the line decoder 50 one of the two output ports (6 and 7) comprised of the output registers 61*a* and 61*b* (FIG. 4C). Each of the registers 52*a*–52*d*, 61*a* and 61*b*, and multiplexing circuit 56*a* is therefore either an input port or an output port for the microprocessor 33 with the corresponding port numbers (0 to 7) being shown in FIGS. 4B and 4C. When data is to be received from the shaft encoders 30 and 31 the line decoder 50 decodes the address and sends an enable signal on output line CS2 to one input of the AND-gate 64*b*. The memory interface 40 also shortly thereafter provides an output (OUT) pulse derived from the clock generator 42 which is coupled to the second input of the gate 64*b* causing gate 64*b* to provide a "parallel-load" signal to pin 8 of each of the registers 52*a*–52*d* to thus load in the current data from the shaft encoders. The Gray coded signals which are stored in registers 52*a*–52*d* are converted into the standard binary code by the Gray-to-binary converters 54*a*–54*d* (FIG. 4B) and applied to the input leads of the 4-bit digital multiplexers 56*b* and 56*c*. The processor 33 subsequently sends address and input (IN) signals over lines D8-D1 to the memory interface 40 which, in turn, sends address signals over lines C8-C1 to the line decoder 50. Each address signal from the decoder 50 enables one of the gates 58*c*–58*f* (FIG. 4B) so that the subsequent IN signal from the interface 40 will cause the data from the appropriate converter 54*a*–54*d* to be gated through the 4-bit digital multiplexers 56*b* and 56*c*. The multiplexer 56*b* gates the input signals on lines AZ9–AZ6' to the corresponding output leads I/08–I/01 when a signal is applied to the gating lead 7 by providing a signal CSO to gate 58*c* and gates the input signals AZ5'–AZ2' to the same output leads I/08–I/01 when a signal is applied to the gating lead 9 by providing a signal CS1 to gate 58*d*. Thus, only four bits may be gated through the multiplexers 56*b* and 56*c* at any one time representing the reading at one of the shaft encoder ports 0–3. The data which is available on the I/O leads of registers 56*b* and 56*c* is received by the memory interface 40 and transferred to the microprocessor 33. The microprocessor then stores this data in the data memory 34 for use at a later time in performing the computations which determine whether or not the gun should be elevated.

In a similar manner, the microprocessor 33 sends a request to move the data represented by the status of input switches 45*a*–45*g* through the 4-bit multiplexer 56*a* by sequentially providing enabling signals to gates 58*a* and 58*b*. This data is thus transferred, 4 bits at a time, through the multiplexer 56*a* and into the memory interface 40 which transfers it to the microprocessor 33 which, in turn, transfers it into the data memory 34. The microprocessor then proceeds to compare the fresh data in the data memory 34 with the deck clearance map and the other fixed parameters in the program memory 28 to determine if the firing of the gun 17 should be inhibited, if the rotation of the turret 14 carrying the gun should be inhibited in either direction, and if the position of the gun should be elevated to allow the gun to clear one of the barriers which are present on the deck 11 of the gun carrying vehicle 10.

When it is desired that signals be sent out which inhibit the firing of the gun 17, or cause the gun to be elevated, or inhibit the clockwise or counter-clockwise rotation of the gun turret 14, address signals from the processor 33 are transmitted on lines D8-D1 to the memory interface 40 to address the proper output port (6 or 7) in the output section of the circuitry (FIG. 4C). These signals are stored temporarily in the memory interface 40 while the address of the proper output port is transmitted on lines C8-C1 to the line decoder 50 (FIG. 4A). The address signals are decoded by the line decoder 50 and transmitted on lines CS6 and/or CS7 to enable the gates 63*a* and/or 63*b* (FIG. 4C) which cause the registers 61*a* and/or 61*b* to be loaded with the signals. When an inhibit firing signal is present in the register 61*a* this signal is coupled to the fire control unit 38 to prevent the gun from firing. In a similar manner, a signal to elevate the gun or to inhibit the clockwise rotation of the gun turret 14 is coupled to one of the solenoid drivers 36 from the register 61*a* (output port 6). A signal to inhibit the counterclockwise rotation of the gun turret is coupled to the appropriate solenoid driver through register 61*b* (output port 7).

The gun elevation system 73 (FIG. 3) includes a conventional hydraulic lifting system (not shown) having a hydraulic motor and a pair of hydraulic valves which control the flow of fluid to power the motor. One of the hydraulic valves is manually controlled by the gunner and causes the gun to be elevated when the valve is in a first position, causes the gun to be lowered when the valve is in a second position, and maintains the gun at a fixed level when the valve is in a third position. The second hydraulic valve is controlled by one of the solenoid drivers 36 and overrides the control by the gunner when the appropriate solenoid driver is energized. The energized solenoid driver causes the second valve to be opened so that the gun is elevated at its maximum rate to enable the gun to clear a deck barrier.

The turret rotation system 75 (FIG. 3) includes the turret 14 which is rotatably mounted on the deck 11 of the vehicle 10 and is powered by a hydraulic motor controlled by a conventional 3-way hydraulic valve (not shown). When the valve is in any of a plurality of positions on one side of center hydraulic fluid flows in a first line directing it in one direction through the motor causing the motor to rotate the turret in a clockwise direction. When the valve is in any of a plurality of positions on the other side of center the hydraulic fluid flows in a second line which directs it in the opposite direction through the motor so that the motor rotates the turret in a counterclockwise direction. When the valve is in its center position there is no flow in either line to the motor and the turret does not rotate. An inhibit valve is provided in each of the lines to the motor to override the control of the 3-way valve. When either of the inhibit valves is closed by the appropriate energized solenoid driver 36 the hydraulic motor is inhibited from rotating the turret in the associated rotative direction. When both of the inhibit valves are closed by the appropriate solenoid drivers, the hydraulic motor is stopped.

The clock generator 42 (FIG. 4A) operates at approximately 740 kilohertz to provide clock signals for the processor 33, the data memory 34 and the memory interface 40. An output signal from the clock generator 42 is also coupled to the "real time clock and interrupt" circuit 43 (FIG. 4A) to provide signals which are reduced to a lower frequency by a divide-by-fourteen counter 67 and by a flip-flop 69 which divides by two the output of the counter 67. The output of flip-flip 69 is directed to a flip-flop 70 which provides an output pulse along with FF-69 and which is reset by an "interrupt acknowledge" pulse (INTA) from the processor 33. The interrupt circuit 43 thus provides an interrupt signal to the processor 33 at regular intervals of approximately 44 milliseconds thereby causing the processor to initiate the program in PROM 28 which, as pointed out previously, first scans the input ports to store data from the azimuth shaft encoder 30, the elevation shaft encoder 31 and the status input switches 45*a*–45*g* in the data memory 34. The program then operates to compare the current position and movement of the gun to the locations and status of the various barriers on the deck of the vehicle to see if it is necessary for the automatic control to take over to inhibit the azimuth travel of the gun, to elevate the gun, and to inhibit the firing of the gun. The entire program in program memory 28 should be completed in much less time than the approximate 44 milliseconds between interrupt pulses in order to insure regular updating at the predetermined frequency so that the velocity and acceleration of the gun can be accurately calculated.

Figure 7A:
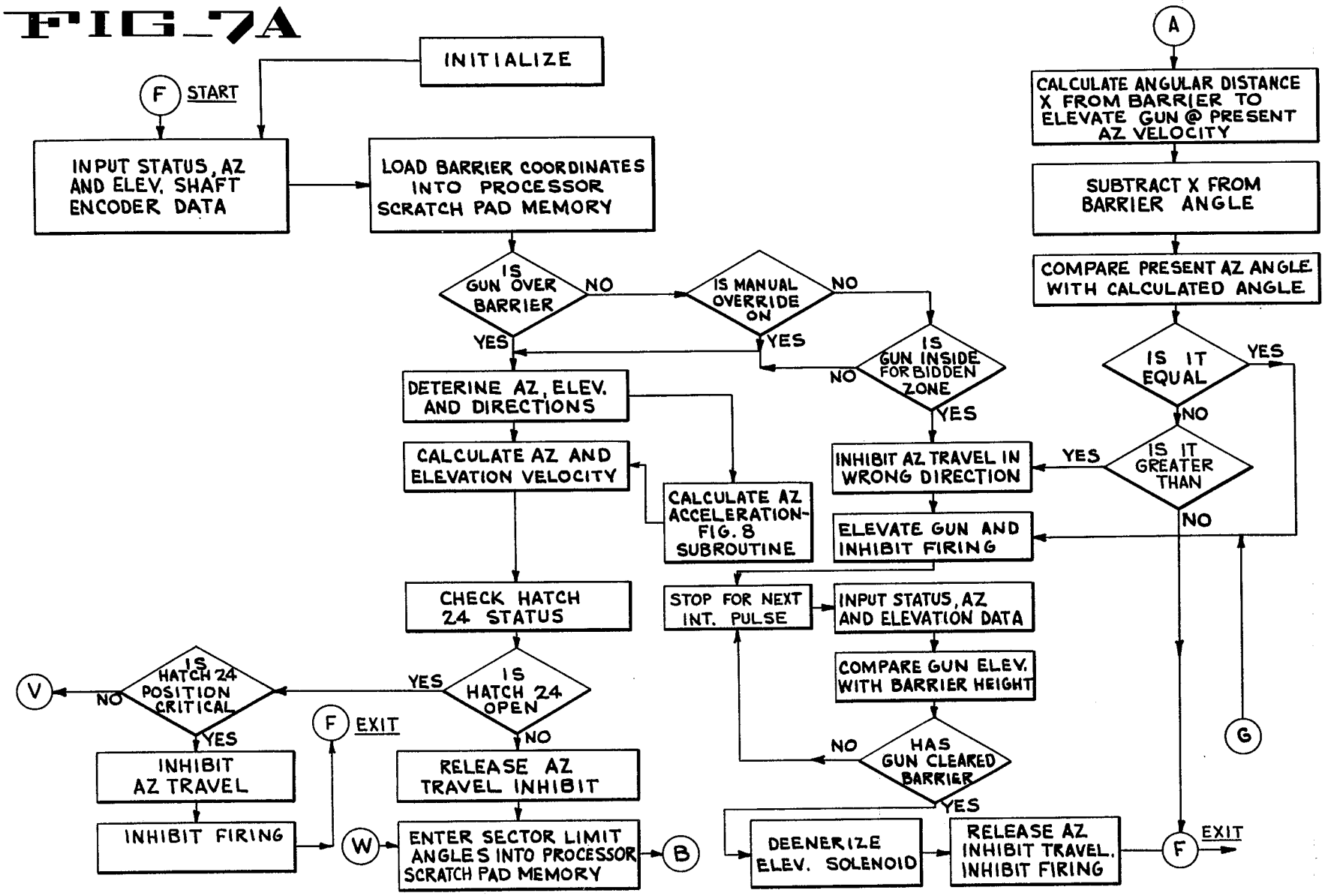
FIGS. 7A, 7B, and 7C together provide a flow chart which describes the manner in which the processor of the gun control system circuitry is programmed.
Figure 7B:
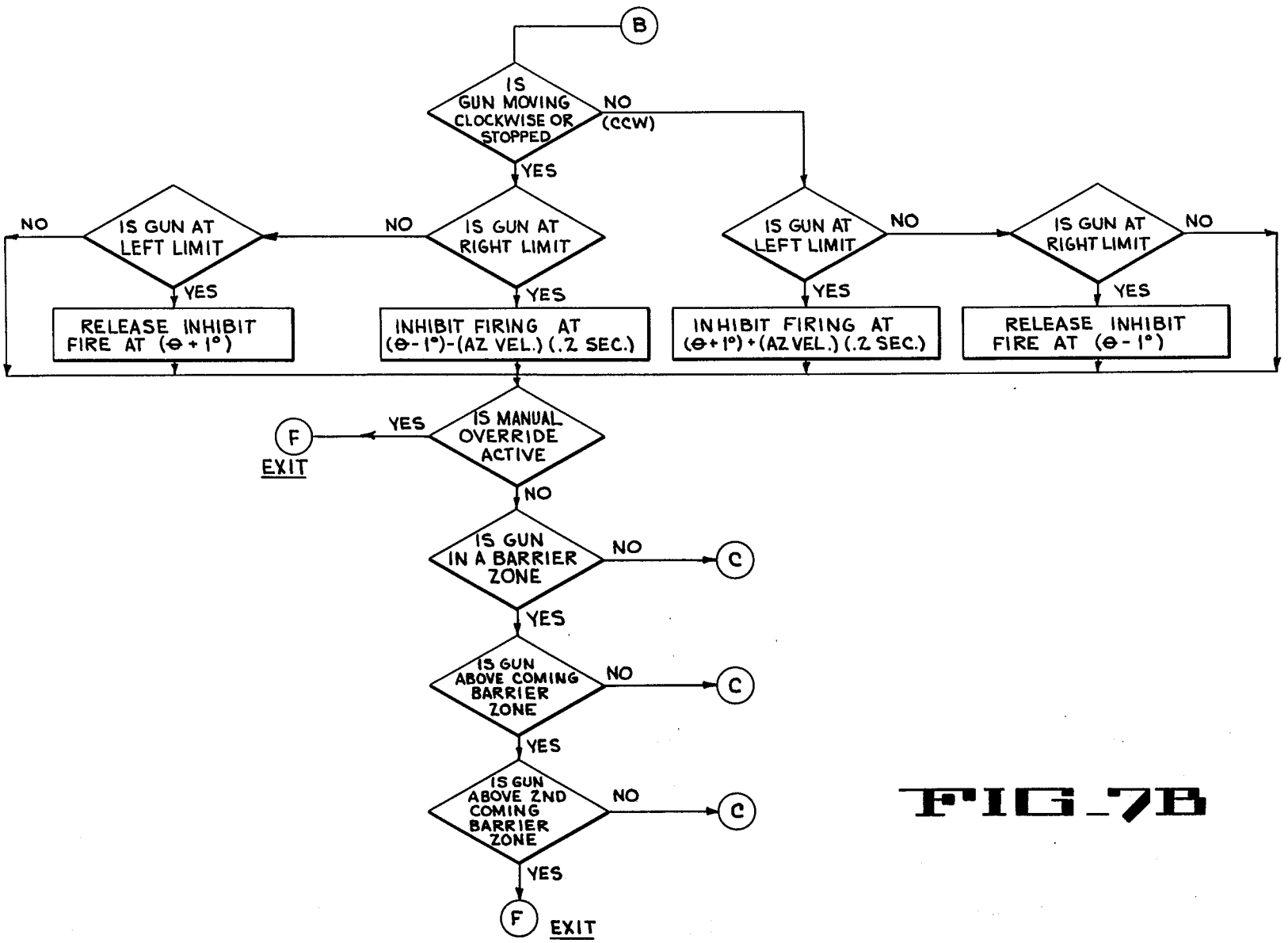
Figure 7C:
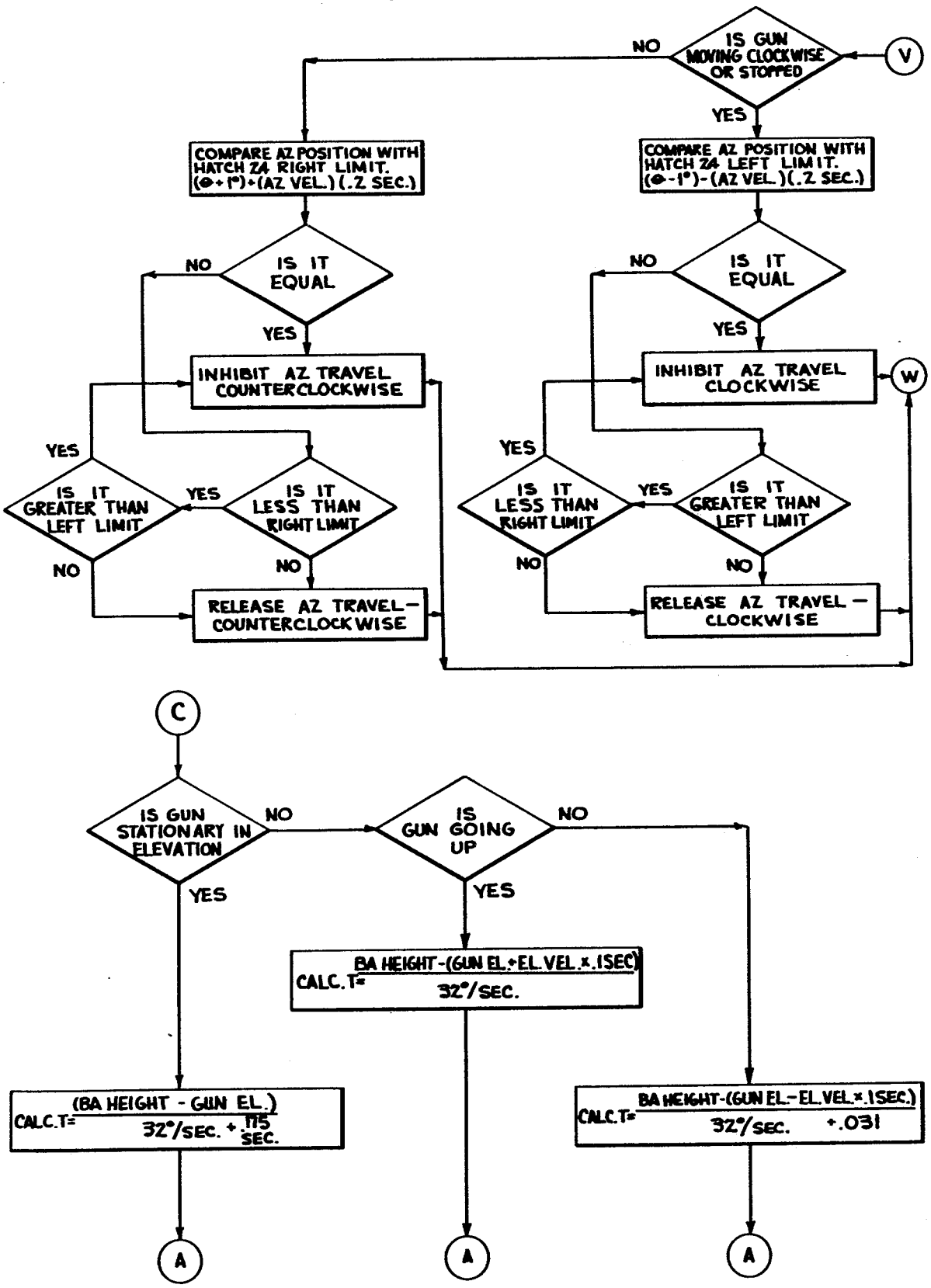

The procedure for checking the movement and relative positions of the gun 17 and the deck obstacles and for using such data to control the operation of the gun will be understood by referring to the program flow chart of FIGS. 7A–7C which illustrates in simplified form the program which is carried by PROM 28. FIGS. 7A, 7B and 7C, taken together, form a complete flow chart from which a programmer of ordinary skill in the art can derive a program for use in PROM 28. It will be appreciated that on the flow chart of FIGS. 7A–7C the various letters A, B, C, G, V and W indicate terminal connections between the different Figures. The letter F indicates the termination or the start of the programming sequence. The diamond shaped blocks in the diagram indicate yes/no logic decisions while the rectangular blocks indicate commands, calculations and various subroutines which are to be performed.

Referring first to FIG. 7A, it will be seen that the initialization step, wherein the various operative components of the processing circuitry are turned on, starts the program sequence. Thereafter, the first step in each program sequence between interrupt pulses always comprises the input of data from the status input switches 45 and the azimuth and elevation shaft encoders 30, 31 with the new information being placed in the data memory 34. The fixed barrier coordinates from the program memory 28 are then brought into the processor 33 and a decision is made as to whether or not the gun 17 is over a barrier, i.e., whether it is in a barrier zone or in the zones (from about 348°–136° and 240°–282°) which are free of barriers. If the gun is not over a barrier and if the manual override is not on another decision is made to determine whether or not the gun is inside a "forbidden zone" which is defined as a zone within a minimum of three degrees of the barrier and a maximum depending on the minimum azimuth distance required to permit the gun to be elevated over the barrier at the present azimuth velocity and maximum elevation speed—such distances being measured in the direction of azimuth travel. If the gun is in a forbidden zone, the azimuth travel in a direction (the "wrong" direction) taking the gun into the barrier is inhibited, the gun is elevated (at the maximum rate), and firing is inhibited. The program is then stopped to await the next interrupt pulse when the gun elevation status is checked and compared with the elevation of the approaching barrier and a decision is made as to whether or not the gun has cleared the barrier. This cycle is repeated until the gun has, in fact, cleared the barrier at which time the elevation of the gun is stopped and the gun is again permitted to be fired and to continue its azimuth travel over the barrier. If, however, the gun is not over a barrier and it was determined that the gun is not inside a forbidden zone, then (as indicated in FIG. 7A) the program would continue as if the gun were over a barrier.

Figure 8:
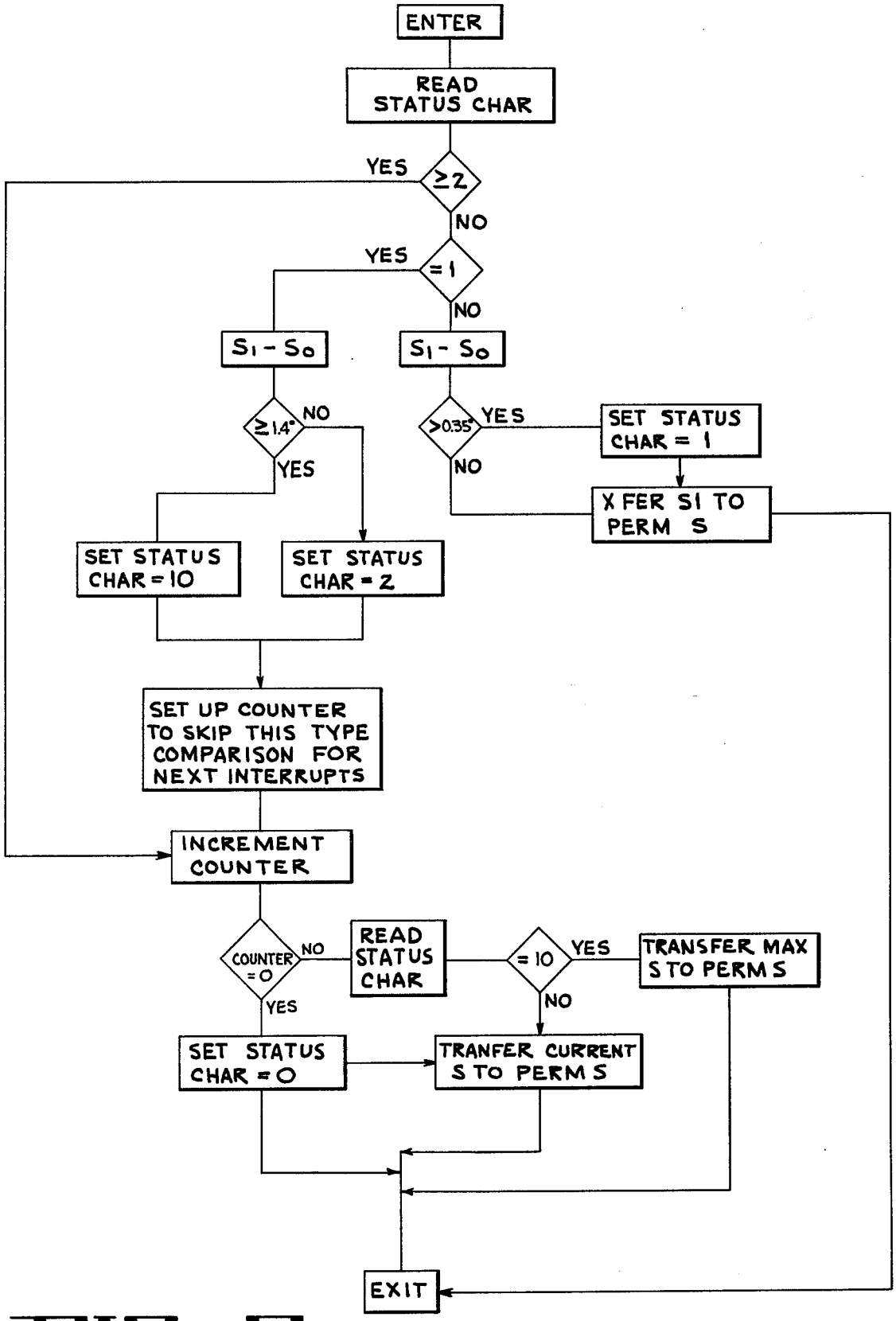
FIG. 8 is a block diagram representation of a subroutine for determining the acceleration of the gun in the azimuth plane as used in the programming scheme diagrammed in FIGS. 7A–7C.

When the gun 17 is over a barrier or in a nonbarrier zone clear of the forbidden zones, the direction of movement in azimuth and elevation is first determined and then the azimuth and elevation velocities are calculated. Such velocities are calculated by comparing the azimuth and elevation positions with the corresponding positions at the last data update and dividing by the fixed time interval. However, in order to get sufficient resolution from the conventional shaft encoding devices 30 and 31, it will be found to be necessary to determine the velocities as measured over five data (i.e., interrupt) pulse intervals, i.e., at five times forty-four milliseconds or 220 millisecond intervals. The traversed distance (indicated by the letter S), however, continues to be updated each interrupt pulse interval and, hence, the distance S traveled over the preceding five pulse interval is changed after each new pulse. A special acceleration calculating routine, as shown in FIG. 8, is provided to determine the S values to be used in the velocity determinations and to particularly take into account the effects of accleration and re-evaluate the S value accordingly. Thus, with particular reference to FIG. 8, the subroutine is entered and a status character (which will be zero under a constant velocity situation) is read. The present distance ($S_1$) in degrees of angular movement is then compared with the prior distance ($S_0$), both taken over the immediately preceding 220 millisecond intervals, and, unless $S_1$ is greater than $S_0$ by 0.35° (indicating an accelerating condition), $S_1$ replaces the previous distance $S_0$ in the new velocity calculation and the current velocity calculation is determined on the basis of $S_1$. If, on the other hand, an accelerating condition is sensed, the status character is first set to equal one; then, on the next interrupt pulse, the new $S_1$ and the prior $S_0$ are again compared. If the $S_1$ is greater than $S_0$ by 1.34° a critical acceleration condition is sensed wherein the status character is set equal to ten indicating a transfer of the maximum distance to the velocity calculation so that the circuitry will indicate that the gun is moving at its maximum azimuth velocity. On the other hand, if $S_1$ minus $S_0$ is less than 1.34° the status character is set equal to two which takes the program through a loop where again the present $S_1$ replaces the previous $S_0$ in the velocity calculation. A counter is incremented in the acceleration subloop so that when any acceleration is sensed $S_1$ and $S_0$ are not compared for a predetermined number of interrupt pulses (4) until the counter rolls over to zero at which time the status character is set back to zero and the whole routine is repeated. It will thus be seen that the processing circuitry normally computes velocity upon the basis of the distance traveled over the immediately preceding 220 millisecond interval but that an acceleration condition is also determined and upon the sensing of a critical acceleration the program will consider that the gun is moving at its maximum velocity toward any barrier which may be in its path for making the subsequent determination of the point at which the gun must start to elevate in order to clear such barrier.

Once the azimuth and elevation velocities have been calculated, a logic decision is made to determine whether or not the commander's hatch 24 is open. If the hatch is not open the program proceeds in a normal manner to consider the firing sector limits, but if the hatch is open it first must be determined whether or not the rotative position is critical, i.e., one wherein rotation of the turret may collide with the opened commander's hatch. If such is the case, all further azimuth travel as well as the firing of the gun is inhibited and the program is terminated until the next interrupt pulse. On the other hand, if the hatch 24 is open but it's position is not critical, it is only necessary to determine the position of the gun relative to the hatch since, as previously pointed out, the gun cannot clear the commander's hatch when it is opened. As shown on FIG. 7C, this determination involves a routine (starting at letter V) wherein a logic decision is made to determine whether or not the gun is moving clockwise or counterclockwise. Then, depending on which direction the gun is moving, the current azimuth position is compared with the left or right limit of the hatch minus or plus one degree as a safety factor and minus or plus the product of the azimuth velocity toward the hatch times 0.2 seconds in order to take into account the movement of the gun. If this calculated, projected gun position is equal to the critical limit position (i.e., the hatch position), further azimuth travel toward the hatch is inhibited as indicated in the flow chart. On the other hand, if the calculated, projected gun position is not equal to the hatch limit, then such calculated position is checked against the other hatch limit to make sure that the gun is not within the hatch area (i.e., in a forbidden zone); if not, azimuth travel is permitted and the normal programming routine is reentered at terminal W.

Returning again to FIG. 7A, at terminal W, the firing sector limits are next considered. If such sector limits are present, they are entered into the processor's scratch pad memory and a subroutine starting at terminal B (FIG. 7B) is entered. First, it is determined whether the gun is moving clockwise or counterclockwise and, depending upon the direction of gun movement, the position of the gun is compared with the right or left limits of the firing sector whereby firing will be inhibited as the gun reaches the sector limit plus (or minus) a one degree safety factor plus (or minus) the product of the azimuth velocity times 0.2 seconds in order to take into account the current gun velocity. As the gun reaches a sector limit firing is inhibited or again permitted depending upon the direction of movement of the gun relative to the firing sector.

Assuming that there are no sector limits or that the gun is safely within the firing sector, the next step in the program is to check to see if the manual override is active, in which case the program is stopped. If the manual override is not on, the program next again determines whether or not the gun is in a barrier zone. If it is not, a subroutine (shown on FIG. 7C) is entered at terminal C wherein a time T is calculated based on whether the gun is stationary, is moving up, or is moving down with the time T in all cases equalling the time required for the gun to clear the next barrier from its present elevational position. In each case, the time T will be seen to equal the next barrier height minus the present gun elevation divided by 32° per second—which is the maximum elevation velocity. The gun elevation is further modified by the product of the current elevation velocity (positive or negative) times 0.1 seconds to accommodate the effect of the current upward or downward movement of the gun. Furthermore, 0.031 seconds and 0.175 seconds are added to the divisor in the computations if the gun is going down or if the gun is stationary, respectively, in order to take into account the inertia factor in reversing the direction of gun movement or in initiating gun movement. Thus, the time T will equal the minimum time required to elevate the gun over the upcoming barrier assuming that the velocity of the gun remains the same. However, if the gun is acclerated, a critical condition may be reached wherein the gun will wind up within a forbidden zone; if such a condition is sensed, all further azimuth travel in the direction toward the barrier (i.e., the "wrong" direction) must be inhibited. Once the calculation T has been made, the program is entered at terminal A (FIG. 7A) to calculate the angular azimuth distance X from the upcoming barrier wherein the elevation of the gun must be started if the gun is to clear such barrier (X=Tx Velocity). This distance X is then substracted from the fixed barrier angle and compared with the present azimuth angle to determine whether or not the gun should be elevated and firing inhibited. However, if due to acceleration it turns out that the gun is already within the forbidden zone, then both azimuth travel and firing are inhibited until the gun clears the barrier (see FIG. 7A).

Returning again to FIG. 7B, and assuming that the gun is over a barrier, the program will look at the next coming barrier to see whether the gun is above it or below it. If it is not above it, the subroutine starting at terminal C (shown on FIG. 7C) is repeated wherein the required gun elevation time T is calculated and a required azimuth distance X is calculated to determine when the gun elevation must be started. Since, it may be possible for a second barrier to pose a greater problem than the next upcoming barrier, the height of the second coming barrier is also compared with the current gun elevation and a decision made as to the time required to elevate the gun from its present position and the azimuth travel distance necessary to do this. Until the gun reaches a position where it must be elevated, the program terminates after checking the position of the next two barriers.

Figure 5:
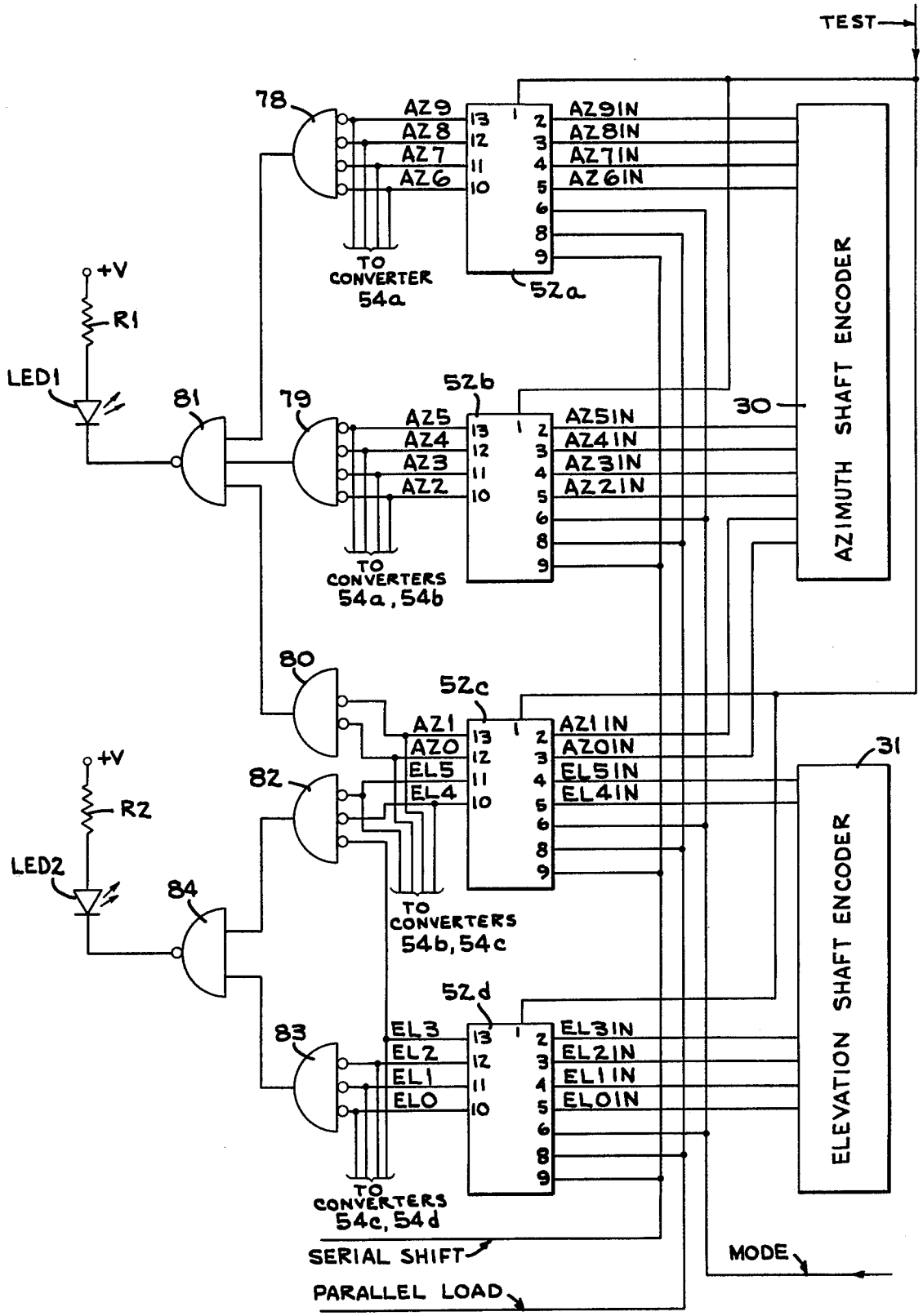
FIG. 5 is a schematic diagram of a portion of the circuitry shown in FIG. 4B particularly showing circuitry which may be used in checking the operation of the gun control system of the present invention.
Figure 5:
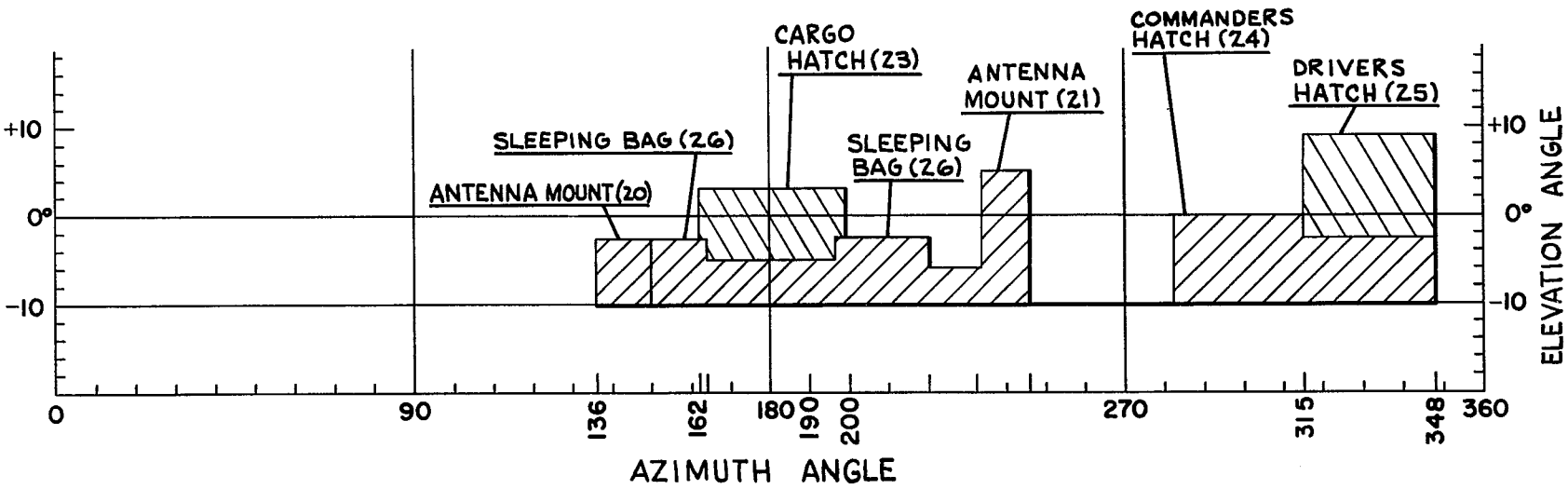

Calibration of the shaft encoders 30 and 31 may be provided by the calibration circuitry shown in FIG. 5 which is arranged to be connected to the output leads of the registers 52*a*–52*d* as shown.

Calibration of the 10-bit azimuth shaft encoder is provided by a plurality of AND gates 78, 79 and 80 (with inverted inputs) and a NAND gate 81, and a NAND gate 84 and AND gates 82 and 83 (with inverted inputs) provide for calibration of the 6-bit elevation shaft encoder. When the elevation shaft is in its true zero position the elevation shaft encoder 31 should provide a signal having a value of zero on each of its output leads. These zeroes are loaded into registers 52*c* and 52*d* as described hereinbefore. Each of the zeroes from the elevation shaft encoder in the registers 52*c* and 52*d* provides a high value of voltage to the input leads of the AND gates 82 and 83 which, in turn, provides a high value of voltage to the input leads of the NAND gate 84 under such "zero elevation" condition. These high values of voltage cause the NAND gate 84 to provide a low value of voltage at the output. This low value of voltage at the output of the NAND gate 84 and the positive voltage +V on serially connected resistor R2 cause a potential to be developed across a light emitting diode LED2 that energizes it and causes it to emit light to indicate that the elevation shaft encoder is in its zero position. If the gun is not in a horizontal position when such a signal is received, th elevation of the gun is then adjusted to a zero horizontal position to correspond to the electrical zero position indicated by the elevation shaft encoder. In a similar manner, each of the inputs to AND gates 78, 79 and 80 has a high logic voltage value when the azimuth shaft encoder 30 is in its zero position to thereby provide a low voltage at the output of NAND gate 81. This energizes LED1 through resistor R1 to indicate that the azimuth shaft encoder is at its zero position, and the gun turret 14 can be adjusted accordingly. The aforedescribed calibration circuitry can also be used to periodically check the operation of the apparatus of the present invention. Thus, the gun can be moved slowly through the zero azimuth position and through the zero elevation position and the corresponding LED1 and LED2 observed to see if they are each energized at the corresponding zero position. If the corresponding LEDs are energized at the proper rotative positions of the gun and turret it indicates that the encoders are providing the proper input signals to the input registers 52*a*–52*d*.

TEST PROGRAM

When a test switch 89 (FIG. 4A) is closed the processor 33 goes into a test routine which has priority over the remaining functions of the processor. The processor sends a request to retrieve a 4-bit test pattern from the program memory 28 with the test pattern being transferred through the memory interface 40 to the scratch pad memory of the processor. The test pattern is also written into each of the memory locations in the data memory 34 is read back from the data memory locations into the processor 33 and compared with the original test pattern which is stored in the scratch pad memory. If these two patterns are not identical the processor 33 sends a warning signal through the memory interface 40 to the output register 61*b* (FIG. 4C). The register 61*b* transfers the warning signal to output lead 14 which energizes a light emitting diode LED3 to tell the operator that there is a defect in the computer circuitry of FIG. 4A which requires correction. If the two patterns are identical the test pattern which is still in the processor 33 is incremented by a count of one by the processor accumulator and the process is repeated with the new bit pattern being written into the memory 34 and then transferred back into the central processor and compared with the test pattern which is still stored in the processor. This test is repeated for each of the sixteen combinations of binary ones and zeroes of a 4-bit test pattern.

The test program conducts a further test by causing the processor to store the original 4-bit test pattern in the output register 61*a* (FIG. 4C), then transfer the output command signals from register 61*a* into special register 62 of the test circuitry (by activating gate 59*a* on line CS6), and then transfer the retranslated output pattern from register 62 through the memory interface 40 back to the processor 33. The processor compares the returning bit pattern with the pattern which was sent out to register 61*a*, and the test is repeated with each of the sixteen possible combinations of the 4-bit test pattern. The processor then repeats this operation by sequentially sending each of the sixteen test patterns to output register 61*b* which sends an output command signal to test storage register 62 by activation of gate 59*b* through line CS7. The register 62 retranslates the output command and directs a 4-bit signal back through the memory interface to the processor where the bit pattern which was sent out is compared with the return pattern. This sequential series of tests checks the operation of the processor 33, the input/output lines, and the output registers 61*a* and 61*b*. These tests also check the operation of the various gates which cause the information to be loaded into the registers 61*a* and 61*b* as well as the operation of the line decoder 50 and the amplifiers 47*a*–47*d*. Any incorrect returning patterns cause the processor to send a warning signal to the diode LED3 (FIG. 4C) by activating gate 63*b* and output register 61*b*.

The processor 33 performs one last series of tests to check the various input registers and the converter circuitry. Thus, a command is transferred to output register 61*b* to activate the "mode" output line. A signal on the "mode" line is directed to each of the input registers 52*a*–52*d* to set up the registers for serial shift input transfer rather than the normal parallel input transfer. The sixteen test patterns are then sequentially transmitted from the processor to output register 61*b* and are transferred out of register 61*b* serially on output line 2, indicated on FIG. 4C as the "test" line. The "test" line is directed to the pin 1 input of each of the input registers 52*a*–52*d* to allow the serial transfer of information into the registers. Then, by activating gate 64*a* (FIG. 4B) data on the "test" line is serially clocked into each of the registers. After one of the test patterns has been loaded into each of the four input registers 52*a*–52*d*, the contents of the registers are transferred out through the Gray-to-binary code converters 54 and the input source selector circuitry 56 back to the processor where they are compared with the original test pattern. This sequence is repeated for each of the sixteen 4-bit test patterns. Again, any incorrect returning test pattern causes a signal to be sent out to output register 61*b* to activate the LED3.

Thus, it can be seen that the control circuitry of the present invention provides a system for maximizing the field of fire of a weapons carrier by comparing the position of a gun with the position of fixed and conditional barriers on the deck of the weapons carrier and by providing control signals which prevent the gun from striking any of the barriers but which permit the gun to move as close as practicable to the barriers so as to maximize the field of fire. The circuitry also provides means for inhibiting the firing of the gun in certain selective rotative sectors. The circuitry also may be operated in a test mode to determine if it is functioning properly.

Although the best mode contemplated for carrying out the present invention has been herein shown and described, it will be apparent that modification and variation may be made without departing from what is regarded to be the subject matter of the invention.

What is claimed is:

1. A gun control system for a gun rotatable in an azimuthal direction and simultaneously elevatable in a vertical direction, said gun being mounted upon a deck having a plurality of barriers thereon, said system comprising:

means for providing signals representative of the size and location of each of said barriers;

means for sensing the horizontal and the vertical angular positions of said gun and for providing signals representative of said positions;

means for periodically comparing successive signals indicative of the horizontal angular positions of said gun and for periodically calculating the horizontal speed of movement of said gun from said periodic comparison;

means for periodically comparing the current vertical angular position of the gun with the size of a barrier being approached and determining an elevation time required to elevate the gun at a fixed elevation speed to clear the barrier, means for providing a signal at a time sufficiently in advance to elevate the gun at said fixed speed to clear the barrier when the gun is moving toward the barrier at an elevation lower than the height of the barrier, said last named means utilizing both the periodically calculated horizontal speed of movement of the gun and the periodically determined elevation time so that initiation of gun elevation for barrier avoidance is a function of both elevation position and azimuth position and velocity whereby the gun will be elevated to narrowly clear the barrier to thereby maximize the field of fire of the gun.

2. A gun control system as defined in claim 1 wherein said barriers may be fixed or conditional, together with means for determining the status of said conditional barriers and means for storing the conditional barrier status information for providing such information to said means for periodically comparing current vertical angular gun position with barrier size.

3. A gun control system as defined in claim 1 wherein said means for providing a signal to elevate the gun provides a signal which moves the gun at its maximum elevation rate when it is caused to be elevated by said means utilizing both the calculated horizontal gun speed of movement and the periodically determined elevation time.

4. A gun control system as defined in claim 1 including means for sensing the acceleration of said gun, and means for revising the calculated horizontal speed of movement of the gun when an acceleration condition is sensed.

5. A gun control system as defined in claim 1 together with means for sending a signal to the gun firing control system for inhibiting firing of the gun when the movement of the gun is being elevated for barrier avoidance.

6. A gun control system as defined in claim 5 including means for setting azimuth firing sector limits, said means for sending an inhibit firing signal responding to said sector limits when the gun is moved out of the firing sector.

7. A gun control system as defined in claim 1 wherein said means for periodically comparing successive horizontal angular position signals and for calculating horizontal speed of movement, said means for comparing current vertical angular position and barrier size, and means for providing a signal to elevate the gun at said fixed speed comprise a microprocessor circuit.

8. A gun control system as defined in claim 7 wherein said system includes alternative closed loop paths through various operative components of the system for transfer of information from and to said microprocessor so that the microprocessor can test the operativeness of said operative components of the system.

9. For use with a vehicle having a gun mounted on a gun turret rotatable in a horizontal plane and having a plurality of barriers on the deck of said vehicle, said vehicle having means for moving said gun in a horizontal plane about the vertical axis of said turret and means for independently pivoting said gun upwardly and downwardly in a vertical plane, a method of controlling the operation of said gun to maximize its field of fire comprising the steps of:

checking the azimuth and elevation positions of said gun at regular intervals of time;

calculating the azimuth and elevation distances traveled by said gun during one of said intervals of time by comparing the current and the last azimuth and elevation positions;

calculating the current azimuth and elevation velocities of said gun by dividing said azimuth and elevation distances, respectively, by said time interval;

calculating the time required to elevate the gun at a fixed elevation speed to clear the next barrier in the direction of azimuth travel of the gun by comparing the present gun elevation with the barrier height and modifying such comparison by the reduced or added time caused by the projected movement of the gun in the vertical plane based on the current elevation velocity;

calculating the azimuth distance from said barrier at which said gun must be elevated based on said calculated time and the current azimuth velocity; and elevating the gun at said fixed elevation speed when said last calculated azimuth distance equals the azimuth distance of the gun from said barrier whereby control of the gun becomes a function of elevation position below said barrier and current elevation velocity.

10. A method as set forth in claim 9 including the additional steps of calculating the azimuth acceleration of the gun by comparing the current azimuth velocity with the previous azimuth velocity; and increasing the current azimuth velocity factor used in calculating the azimuth distance from said barrier at which said gun must be elevated when said calculated azimuth acceleration exceeds a predetermined amount.

11. A gun control system as in claim 1 wherein said means for calculating the horizontal speed of movement provides a signal dependent upon the current calculated azimuth speed of the gun to stop the gun in the azimuth direction when the gun is too close to a barrier to be lifted over the barrier in view of the current azimuth speed.

12. A gun control system as in claim 1 together with means for utilizing said signals representative of barrier size and location, said signals representative of gun positions and said information relative to the calculated horizontal speed of the gun to define forbidden zones within a minimum annular distance of the barriers and a maximum angular distance depending on minimum azimuth distance required to elevate the gun over a barrier at present azimuth speed and maximum elevation speed, so that angular movement toward the barrier is inhibited within said forbidden zones and the gun is elevated.

13. A gun control system as in claim 1 together with means for sensing a critical acceleration condition when subsequent ones of said periodic angular position comparisons indicate increased angular motion exceeding a predetermined amount, said horizontal speed of movement information being provided as maximum velocity in azimuth when said critical acceleration is sensed.

14. A method of controlling a gun mounted in a gun turret on a vehicle, said vehicle having controls and apparatus for moving the gun in azimuth about the vertical axis of the turret and for independently pivoting the gun in elevation within a vertical plane, wherein the vehicle has at least one barrier on the deck thereof lying across a path along which the gun may be controlled, comprising the steps of monitoring the azimuth and elevation positions of the gun, monitoring the azimuth velocity of the gun, comparing the present gun elevation with the height of the barrier, calculating the time required to elevate the gun from the present gun elevation height at a fixed elevation velocity to clear the barrier, determining when the gun must be elevated at said fixed elevation velocity at it approaches the barrier to narrowly clear the barrier based on the calculated time and the current azimuth velocity, and elevating the gun at said fixed elevation velocity when said elevation determination is made, whereby control of the elevation position of the gun becomes a function of elevation position below the height of the barrier and is retained until the gun reaches an azimuth position which maximizes the gun field of fire.

15. The method as set forth in claim 14 including the steps of monitoring the elevation velocity of the gun and modifying the step of calculating the time required to elevate the gun by the reduced or added time resulting from the projected movement of the gun in the vertical plane based on the current elevation velocity.

16. The method as set forth in claim 14 including the steps of obtaining indication of the azimuth acceleration of the gun, and making the determination of when the gun must be elevated based on maximum azimuth velocity of approach toward the barrier when said azimuth acceleration exceeds a predetermined magnitude.

17. A gun control system for a gun which is controllable simultaneously in azimuth and elevation and is mounted on a deck having at least one barrier extending thereabove which lies in a path along which the gun may be controlled, said system comprising means for providing signals representative of the size and location of the barrier, means for sensing the azimuth and elevation positions of the gun and for providing signals indicative thereof, means for comparing successive position signals from the means for sensing and for providing an output indicative of current gun azimuth velocity from said comparisons, means for calculating the time required to elevate the gun from a current elevation position at a fixed elevation velocity to clear the barrier when the gun is approaching the barrier at an elevation below the height thereof and for determining whether elevation of the gun must be initiated at the fixed elevation velocity to clear the barrier based on the calculated time required to elevate the gun and the current azimuth velocity, whereby the gun may be automatically controlled as a function of elevation position to narrowly clear the barrier and thereby maximize the gun's field of fire.

18. A gun control system as in claim 17 together with means for comparing successive position signals from the means for sensing and for providing an output indicative of current gun elevation velocity from said comparisons, means for modifying the calculated time required to elevate the gun at a fixed elevation velocity in accordance with a reduced or added amount of time dependent upon the projected movement of the gun in the vertical direction based on current elevation velocity.

19. A gun control system as in claim 17 together with means for sensing the azimuth acceleration of the gun, and means for revising said output indicative of current gun azimuth velocity in accordance with the sensed acceleration.

20. A gun control system as in claim 17 together with means for inhibiting firing of the gun when the gun is being automatically controlled to clear the barrier.

21. A gun control system as in claim 17 wherein said means for sensing, means for comparing and means for calculating are included in a microprocessor circuit.

22. A gun control system as in claim 21 wherein said system includes alternative closed loop paths through various operative components of the system for transfer of information from and to said microprocessor so that said microprocessor can test the operativeness of said operative components.

23. A gun control system as in claim 17 together with circuit means for stopping the gun in azimuth travel when the gun is too close to the barrier to be lifted thereover at said fixed elevation velocity in view of the current azimuth velocity.

24. A gun control system as in claim 21 wherein said microprocessor includes means for utilizing said signals representative of the size and location of the barrier, said signals indicative of gun azimuth and elevation positions and said output indicative of current gun azimuth velocity to define forbidden zones within a minimum angular distance of the barrier and a maximum angular distance based on minimum azimuth distance required to elevate the gun over the barrier at current azimuth velocity and maximum elevation velocity, so that angular movement toward the barrier is inhibited within said forbidden zones and the gun is elevated.

25. A gun control system for a gun which is controllable simultaneously in azimuth and elevation and is mounted on a deck having at least one barrier extending thereabove which lies in a path along which the gun may be controlled, said system comprising means for providing signals representative of the size and location of the barrier, means for sensing the azimuth and elevation positions of the gun and for providing signals indicative thereof, means for comparing successive position signals from the means for sensing and for providing an output indicative of current azimuth and elevation gun velocities from said comparisons, means for calculating the time required to elevate the gun from a current elevation position at a fixed elevation velocity to clear the barrier when the gun is approaching the barrier at an elevation below the height thereof and for determining whether elevation of the gun must be initiated at the fixed elevation velocity to clear the barrier based on the calculated time required to elevate the gun and the current azimuth velocity, and means for modifying the calculated time required to elevate the gun at a fixed elevation velocity in accordance with a reduced or added amount of time dependent upon the projected movement of the gun in the vertical direction based on current elevation velocity, whereby the gun may be automatically controlled to narrowly clear the barrier and thereby maximize the gun's field of fire.

26. A gun control system as defined in claim 1 together with means for comparing successive signals indicative of the vertical angular positions of said gun and for periodically calculating the vertical speed of movement of said gun from said periodic comparison, and means for modifying the determined elevation time, dependent upon the projected movement of the gun in the vertical direction based on current vertical speed of movement.

* * * * *